US012127691B2

(12) United States Patent
Koo et al.

(10) Patent No.: US 12,127,691 B2
(45) Date of Patent: Oct. 29, 2024

(54) APPARATUS FOR ASSISTING SLEEP

(71) Applicant: RaRas Inc., Incheon (KR)

(72) Inventors: Jinsoon Koo, Yongin-si (KR); Eunnim Cho, Suwon-si (KR)

(73) Assignee: RARAS INC., Incheon (KR)

( * ) Notice: Subject to any disclaimer, the term of this patent is extended or adjusted under 35 U.S.C. 154(b) by 19 days.

(21) Appl. No.: 17/871,321

(22) Filed: Jul. 22, 2022

(65) Prior Publication Data

US 2023/0157457 A1 May 25, 2023

(30) Foreign Application Priority Data

Nov. 24, 2021 (KR) ..... 20-2021-0003567

(51) Int. Cl.
*A47D 13/08* (2006.01)
*A47D 13/00* (2006.01)
*A47G 9/10* (2006.01)

(52) U.S. Cl.
CPC ..... *A47D 13/08* (2013.01); *A47G 9/1045* (2013.01); *A47D 13/00* (2013.01); *A47G 9/10* (2013.01)

(58) Field of Classification Search
CPC ..... A47D 13/08; A47D 13/00; A47D 15/001; A47D 15/00; A47G 9/1045; A47G 9/10; A47C 20/02; A47C 20/00
USPC ..... 5/655, 652, 657, 632, 630
See application file for complete search history.

(56) References Cited

U.S. PATENT DOCUMENTS 2,013,481 A * 9/1935 Stonehill ..... A47C 7/425 5/640
3,911,512 A * 10/1975 Plate ..... A47C 13/00 5/636
5,387,177 A * 2/1995 Dunn ..... A61G 7/07 5/655
5,572,757 A * 11/1996 O'Sullivan ..... A47C 7/46 5/636
6,347,421 B1 * 2/2002 D'Emilio ..... A47C 7/383 5/636
6,578,218 B2 * 6/2003 Wassilefsky ..... A61G 7/0755 5/640
6,640,368 B2 * 11/2003 Roston ..... A47C 20/021 5/655.9
6,779,211 B1 * 8/2004 Williams ..... A47D 13/08 5/640
7,017,215 B1 * 3/2006 Singer ..... A61G 13/12 5/646

(Continued)

FOREIGN PATENT DOCUMENTS

CN 214207961 U 9/2021
JP 3049661 U 6/1998

(Continued)

*Primary Examiner* — Robert G Santos
(74) *Attorney, Agent, or Firm* — Hauptman Ham, LLP

(57) ABSTRACT

An apparatus for assisting sleep according to one embodiment of the present invention includes: a main body which includes two bodies configured to support the body of a baby and configured so that one end portion of one body and one end portion of the other body are connected to each other and two heads formed at the other end portions of the two bodies and stacked while intersecting with each other to support the head of the baby; and a support portion which is formed at the main body and configured to support the head and neck of the baby from a circumference thereof.

10 Claims, 6 Drawing Sheets

(56) References Cited

U.S. PATENT DOCUMENTS

| | | | | | |
|---|---|---|---|---|---|
| 7,114,206 | B2 * | 10/2006 | Leach | A47C 20/021 | 5/652 |
| 7,353,552 | B2 * | 4/2008 | Leach | A47C 20/021 | 5/652 |
| 7,441,293 | B1 * | 10/2008 | Singer | A47C 20/023 | 5/632 |
| 7,562,406 | B1 * | 7/2009 | Leach | A47D 13/08 | 5/655 |
| 7,886,381 | B2 * | 2/2011 | Aiken | A47C 20/025 | 5/636 |
| 2002/0088057 | A1 * | 7/2002 | Wassilefsky | A61G 7/0755 | 5/648 |
| 2003/0046767 | A1 * | 3/2003 | Roston | A47C 20/021 | 5/648 |
| 2005/0278864 | A1 * | 12/2005 | Leach | A47C 20/023 | 5/732 |
| 2007/0028384 | A1 * | 2/2007 | Leach | A47C 20/023 | 5/632 |
| 2010/0175192 | A1 * | 7/2010 | Aiken | A47C 20/023 | 5/632 |
| 2023/0157457 | A1 * | 5/2023 | Koo | A47D 13/08 | 5/655 |

FOREIGN PATENT DOCUMENTS

| | | | | |
|---|---|---|---|---|
| KR | 20-2011-0008872 | U | 9/2011 | |
| KR | 20-2014-0005410 | U | 10/2014 | |
| KR | 20-0493969 | Y1 | 7/2021 | |
| KR | 10-2330039 | B1 | 11/2021 | |
| WO | WO-2023096061 | A1 * | 6/2023 | A47D 13/08 |

* cited by examiner (a)

(b)

( a )

( b )

APPARATUS FOR ASSISTING SLEEP

CROSS-REFERENCE TO RELATED APPLICATION

This application claims priority to and the benefit of Korean Utility Model Application No. 20-2021-0003567, filed on Nov. 24, 2021, the disclosure of which is incorporated herein by reference in its entirety.

BACKGROUND

1. Field of the Invention

The present invention relates to an apparatus for assisting sleep, and more particularly, to an assistive device that helps a baby maintain a consistent sleep position.

2. Discussion of Related Art

Generally, cushions, pillows, or the like are essential items when sleeping.

The cushions or pillows are usually filled with cotton, synthetic resin, or grains and have a cushioning function and a certain height and are configured to support the head or body during sleep.

Meanwhile, an example of pillows or cushions for babies include a long pillow or cushion that can be held in the baby's arms while the baby rests his or her head thereon. Such a pillow or cushion (10) has a long cylindrical shape as a whole as illustrated in FIG. 1.

The cylindrical pillow or cushion (10) has a continuous, elongated cylindrical shape and is placed in front of and behind the baby's body and simply supports the baby's body from the front and back when the baby is asleep.

That is, the conventional cylindrical pillow or cushion (10) is simply disposed close to the baby's body and is not configured to be in close contact with and wrapped around the baby's body and thus does not realize a stable sleeping environment in which the baby is surrounded as when being held in a mother's arms. Accordingly, there are problems that the baby may frequently wake up due to the Moro reflex or the like and such a sleep pattern does not help at all for the baby's sleep education.

Further, when the baby continuous to lie on his or her back instead of lying on his or her side, a head deformity in which the back of the head is flattened (flat head syndrome, plagiocephaly, brachycephaly, etc.) occurs, and this actually serves as a fundamental problem in making the head round. However, all of the conventional cushions or pillows for head shape correction have a structure that corrects the head shape only when the baby is lying on his or her back.

RELATED ART DOCUMENT

[Patent Document]
Korean Utility Model Publication No. 20-2014-0005410

SUMMARY OF THE INVENTION

The present invention is directed to providing an apparatus for assisting sleep that allows a baby to sleep while stably lying on his or her side for head shape care and stable sleep without the Moro reflex.

An apparatus for assisting sleep according to one embodiment of the present invention includes: a main body which includes two bodies configured to support the body of a baby and configured so that one end portion of one body and one end portion of the other body are connected to each other and two heads formed at the other end portions of the two bodies and stacked while intersecting with each other to support the head of the baby; and a support portion which is formed at the main body and configured to support the head and neck of the baby from a circumference thereof.

Here, the support portion may include an occipital region support step which is formed thicker than other parts to protrude upward from one side portion of the head to support the occipital region of the baby from a lateral direction and a lower side in the lateral direction in a state in which the two heads are stacked while intersecting with each other to support the temporal region of the baby.

Also, an insertion groove may be formed in a central portion of the head so that a portion of the temporal region is inserted therein.

Also, one of the two bodies may include: a support body configured to support the back of the baby's body from the lateral direction; and a first support formed to protrude in a direction inclined downward from a lower portion of a side of the support body that supports the back of the baby's body in order to support the spine of the baby from the lower side in the lateral direction.

Also, the body may further include a second support formed to protrude in a direction inclined upward from an upper portion of the side of the support body that supports the back of the baby's body in order to support the spine of the baby from an upper side in the lateral direction.

Meanwhile, one of the two bodies may include the support body configured to support the back of the baby's body from the lateral direction, and the support portion may further include a back neck support step which is formed to extend from the support body to an inner side of the head and formed thicker than the head to protrude upward therefrom in order to support the baby's back neck from the lateral direction and the lower side in the lateral direction.

Here, the back neck support step may be formed in a shape that matches the outer shape of the back neck and may have an edge formed to be curved.

Further, the two heads stacked while intersecting with each other to support the baby's head may have a double step area formed in which a portion of the occipital region support step supports the back neck support step and the occipital region support step and the back neck support step intersect with each other, and in the double step area, the occipital region support step may lift the back neck support step and cause the back neck support step to be in close contact with the back neck of the baby.

Also, the two bodies may be formed to have a structure in which connecting portions are attached to and detached from each other by a connecting zipper.

Further, each of the bodies and the heads may be filled with a filler, and a zipper opening/closing portion may be formed to allow entry and exit of the filler into and from each of the bodies and the heads.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

Figure 1:
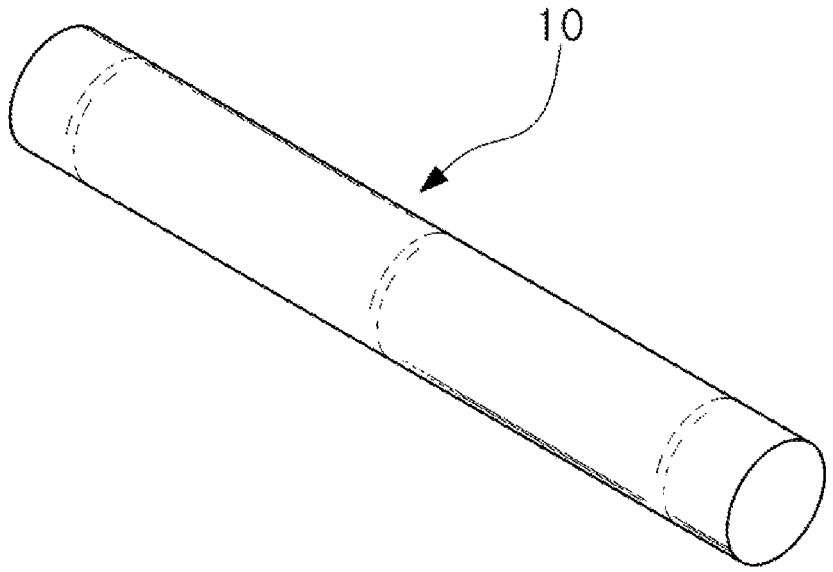
FIG. 1 Prior Art
FIG. 1 is a view illustrating a cushion according to the related art.
Figure 1:
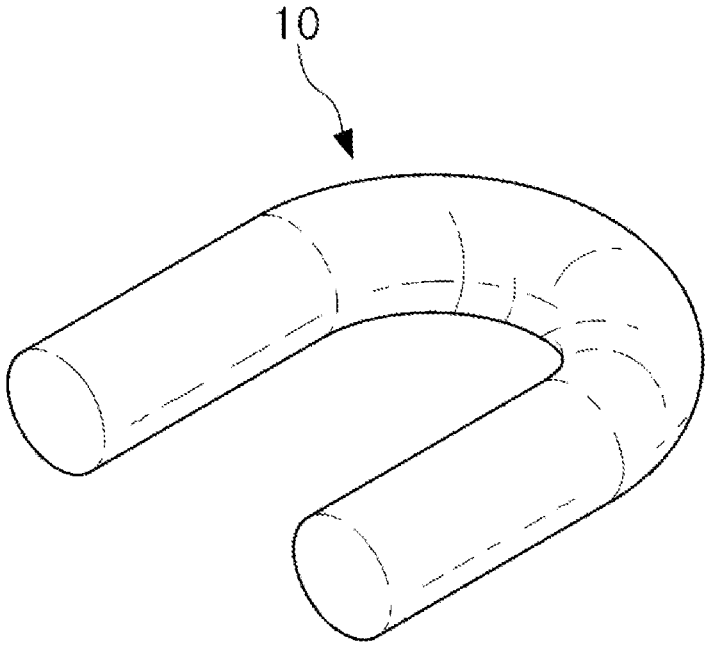
FIG. 1 Prior Art

Hereinafter, exemplary embodiments of the present invention will be described in detail. In assigning reference numerals to components of each drawing, it should be noted that the same components are denoted by the same reference numerals wherever possible regardless of the drawings. Also, in describing the present invention, when detailed description of a related known configuration or function is determined as having the possibility of obscuring the gist of the present invention, the detailed description thereof will be omitted.

Figure 2:
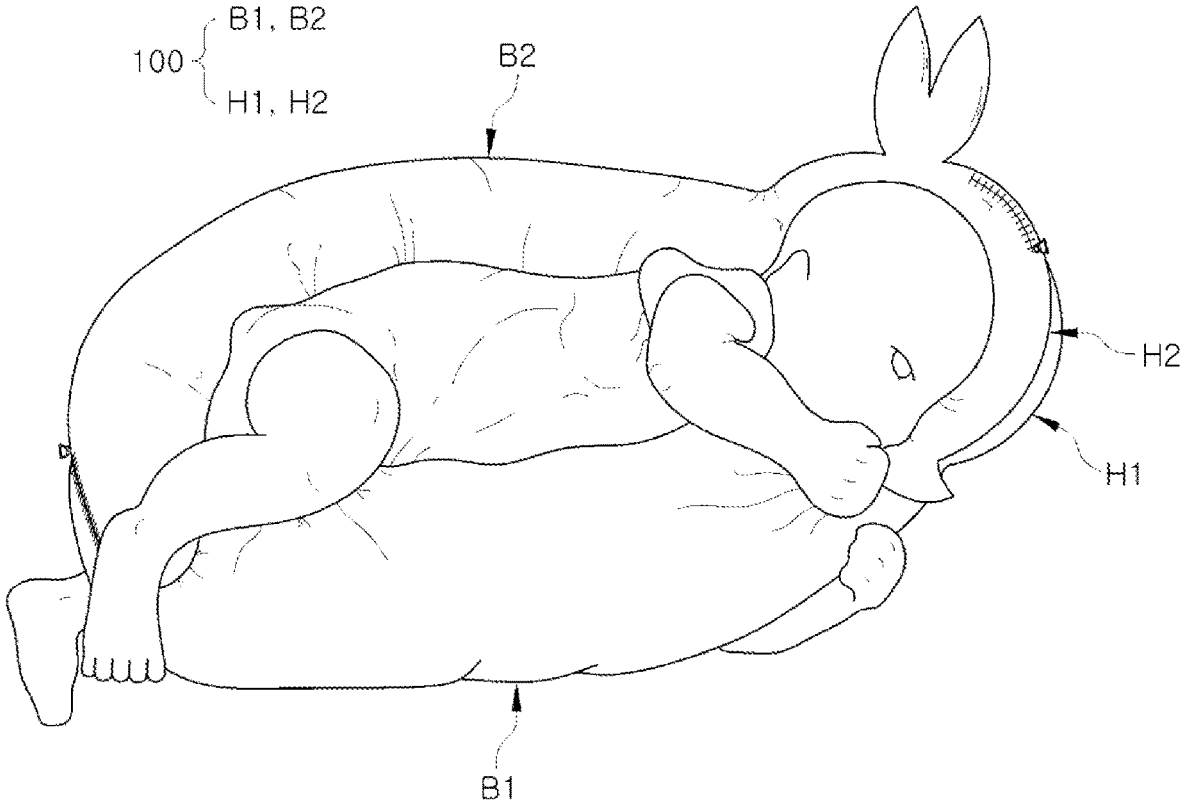
FIG. 2 is a view illustrating a state in which a baby is supported by an apparatus for assisting sleep according to one embodiment of the present invention.
Figure 3:
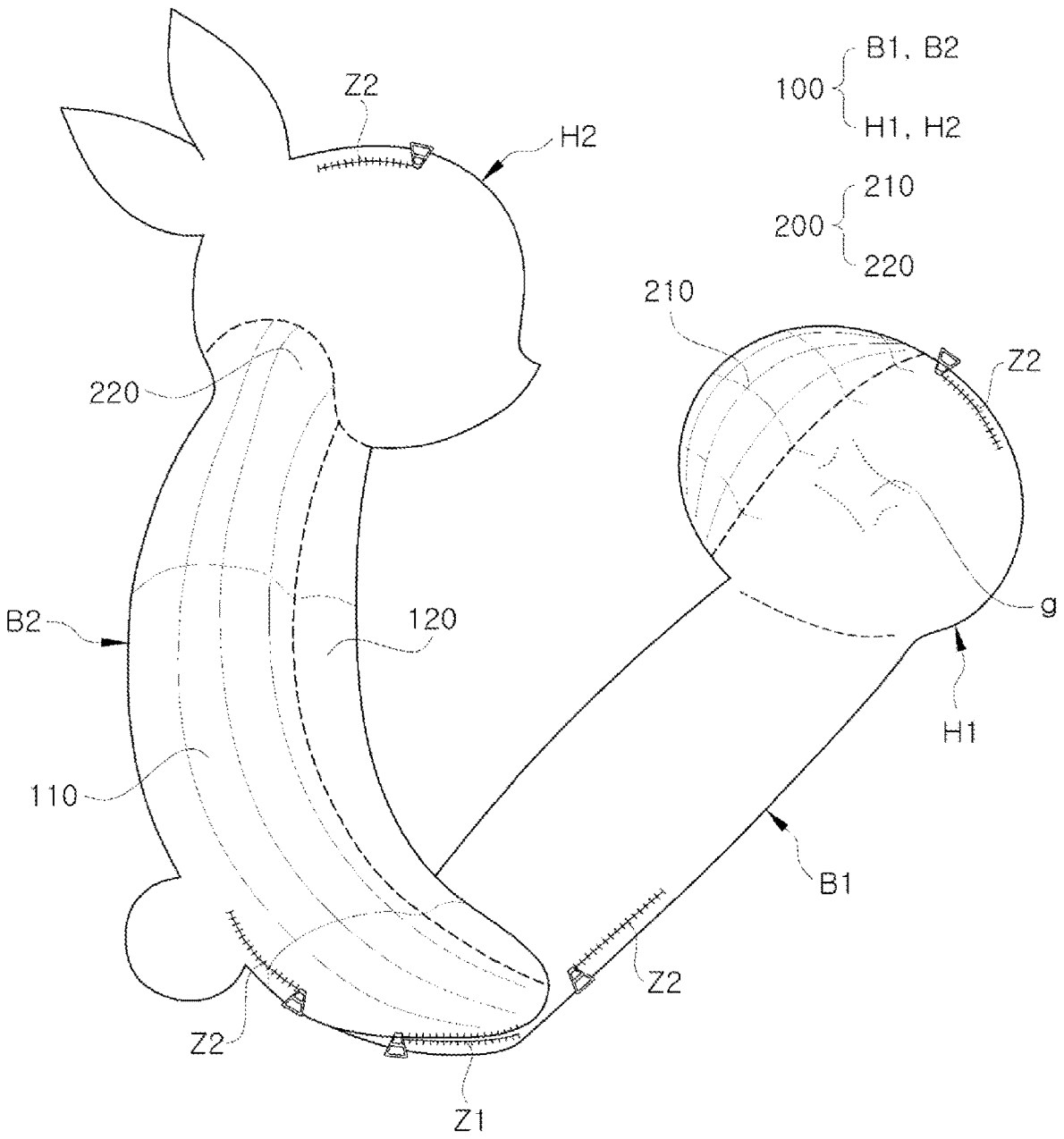
FIG. 3 is a view illustrating the apparatus for assisting sleep of FIG. 2.
Figure 4:
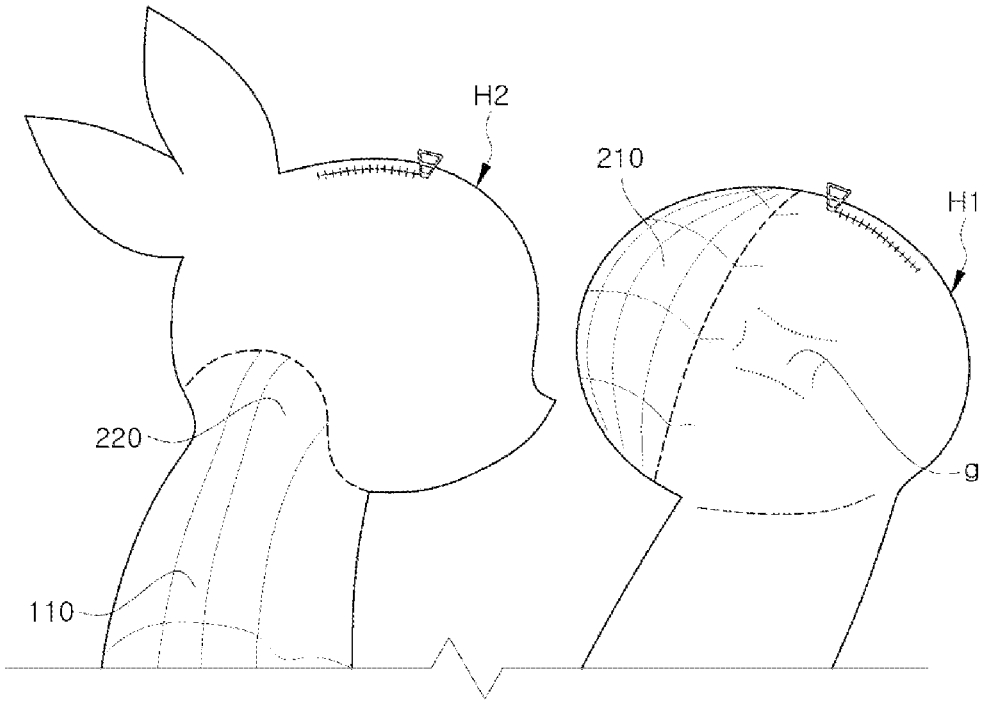
FIG. 4 is a view illustrating a state in which the head and neck of the baby are supported from a circumference thereof by the apparatus for assisting sleep of FIG. 3.
Figure 4:
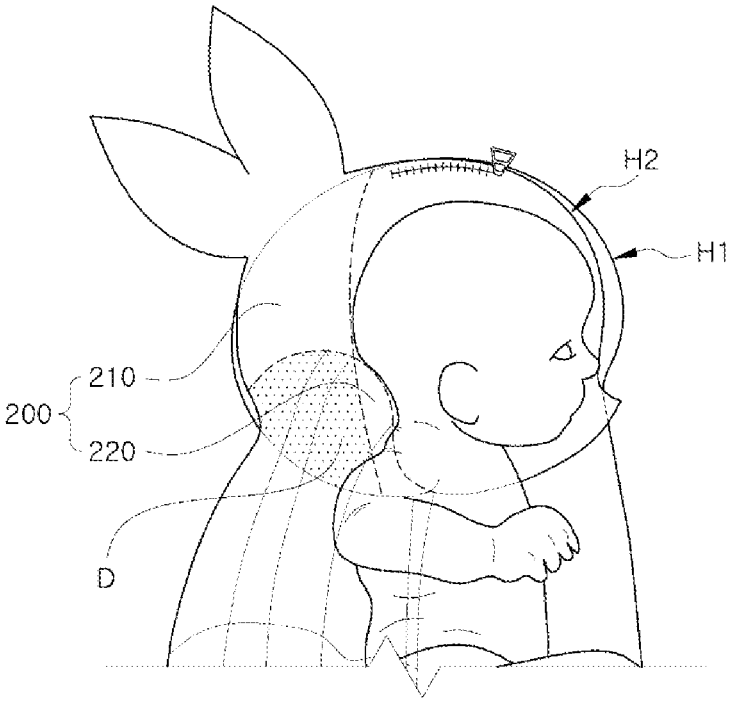

FIG. 2 is a view illustrating a state in which a baby is supported by an apparatus for assisting sleep according to one embodiment of the present invention, FIG. 3 is a view illustrating the apparatus for assisting sleep of FIG. 2, and FIG. 4 is a view illustrating a state in which the head and neck of the baby are supported from a circumference thereof by the apparatus for assisting sleep of FIG. 3.

Referring to the drawings, the apparatus for assisting sleep according to the present invention includes a main body 100 and a support portion 200.

The main body 100 includes two bodies B1 and B2 and two heads H1 and H2.

Here, the bodies are configured to support the baby's body and have a shape that is elongated to correspond to the length of the baby's body to support the baby's body in the longitudinal direction.

Also, the heads are connected to the bodies and respectively formed at one end portion of one body and one end portion of the other body and are stacked while intersecting with each other to support the baby's head.

Hereinafter, as a specific example, the two bodies B1 and B2 will be described by being referred to as a first body B1 and a second body B2, and the two heads H1 and H2 will be described by being referred to as a first head H1 and a second head H2, based on the drawings.

The first body B1 supports the front of the baby's body (the front of the body including the chest), and the second body B2 supports the back of the baby's body (the back of the body including the back).

The first body B1 and the second body B2 have a shape that is elongated to correspond to the length of the baby's body to support the baby's body in the longitudinal direction.

Also, one end portion of the first body B1 and one end portion of the second body B2 are connected to each other, and connecting portions are disposed between the baby's legs when the baby is lying on his or her side between the first body B1 and the second body B2.

Substantially, as illustrated in the drawings, the baby's legs are placed on the first body B1 supporting the front of the baby's body, and here, the connecting portions of the first body B1 and the second body B2 are disposed adjacent to the baby's crotch.

Here, the first body B1 and the second body B2 may have a structure in which the connecting portions are attached to and detached from each other by a connecting zipper Z1.

Thus, the first body B1 and the second body B2 may each be utilized as a long body pillow and facilitate storage or washing (laundering) when separated from each other.

Further, at least one of the first body B1 with the first head H1 or the second body B2 with the second head H2 may be utilized as a vehicle seat belt cushion, and in this case, a link portion (not illustrated) having Velcro tape may be included to allow connection to a seat belt. The link portion may be fixed to each of the first body B1 or the second body B2, a seat belt may be inserted into and surrounded by an open portion of the link portion, and the open portion may be closed by the Velcro tape so that the first body B1 or the second body B2 is held on the seat belt.

Also, the heads include the first head H1 and the second head H2.

The first head H1 is connected to the other end portion of the first body B1, and the second head H2 is connected to the other end portion of the second body B2.

Here, the first head H1 and the second head H2 are stacked while intersecting with each other, and the temporal region of the baby is placed thereon so that the temporal region is supported by the first head H1 and the second head H2 stacked while intersecting with each other. That is, as illustrated in the drawings, the baby's head is placed on the second head H2.

Further, each of the first body B1, the first head H1, the second body B2, and the second head H2 is filled with a filler.

Here, a zipper opening/closing portion Z2 may be formed to allow entry and exit the filler into and from the first body B1, the first head H1, the second body B2, and the second head H2.

The conventional cylindrical cushion or pillow 10 (see FIG. 1) has a continuous, elongated cylindrical shape without a configuration to support the baby's head and neck from the circumference thereof like the support portion 200 of the present invention which will be described below and is placed in front of and behind the baby's body and simply supports the baby's body from the front and back when the baby is asleep.

That is, the conventional cylindrical pillow or cushion is simply disposed close to the body of the baby lying on his or her side and is not configured to reliably support the baby's head and body from the lateral direction, and thus there is a limitation in that the baby is not stably and firmly supported and does not maintain lying on his or her side. Further, since it is not possible to realize a stable sleeping environment in which the baby is surrounded as when being held in a mother's arms, the baby may frequently wake up due to the Moro reflex or the like, and such a sleep pattern is not beneficial for the baby's sleep education.

Further, newborns need a good head support because they are not yet able to properly control their bodies. Because the development of the neck muscles is immature despite the weight of the baby's head accounting for about 10% of the baby's weight, it is very important to support the baby's neck well.

Therefore, in order to overcome the above limitation and to especially support the baby's head well, the present invention includes the support portion 200, and the support portion 200 is formed at the main body 100 and configured to support the baby's head and neck from the circumference thereof.

However, an insertion groove g will be described prior to detailed description of the support portion 200. The insertion groove g may be formed in a central portion of one of the two heads H1 and H2 to stably support the temporal region of the baby. In this case, as an example, the insertion groove g may be formed in the first head H1 as illustrated in the drawings.

The insertion groove g is formed in the central portion of the first head H1 so that the baby's temporal region is inserted thereinto to a certain extent together with the second head H2 when placed on an upper portion of the stacked second head H2.

That is, as the baby's temporal region moves downward toward the insertion groove g together with the central portion of the second head H2 due to the structure of the insertion groove g of the first head H1 as the second head H2 moves downward, the baby's head is stably centered.

Also, the support portion 200 includes an occipital region support step 210.

The occipital region support step 210 is configured to support the baby's occipital region.

Specifically, the occipital region support step 210 is formed on at least one of the two heads H1 and H2 so that the baby's occipital region is supported from the lateral direction and the lower side in the lateral direction in a state in which the baby's temporal region is supported by the two heads H1 and H2 stacked together.

The occipital region support step 210 is formed thicker than other parts of the head to protrude upward from one side portion of at least one of the two heads H1 and H2.

As an example, the occipital region support step 210 may be formed thicker than other parts to protrude upward from one side portion of the first head H1 as illustrated in the drawings.

The occipital region support step 210 may push one upper side of the stacked second head H2 to support the occipital region of the baby's head, which is supported by the second head H2, from the lateral direction and the lower side in the lateral direction. In this way, the baby's occipital region can be stably and firmly supported while the baby is lying on his or her side.

Also, the support portion 200 may further include a back neck support step 220.

The back neck support step 220 is configured to support the baby's back neck.

Specifically, the back neck support step 220 is formed on at least one of the two bodies B1 and B2 to support the baby's back neck from the lateral direction and the lower side in the lateral direction.

The back neck support step 220 may be formed to extend from a support body 110 of at least one of the two bodies B1 and B2 to an inner side of the head and may be formed thicker than the head to protrude upward therefrom.

As an example, as illustrated in the drawings, the back neck support step 220 may be formed to extend from the support body 110 of the second body B2 to an inner side of the second head H2 and may be formed thicker than the second head H2 to protrude upward therefrom.

Here, in the second body B2, the support body 110 is a portion configured to support the back of the baby's body from the lateral direction and has a structure that is thick in the up-down direction to have a height relatively higher as compared to the second head H2.

The back neck support step 220 supports the baby's back neck that is supported by the second head H2. Here, by having a structure that extends from the support body 110 of the second body B2, the back neck support step 220 is configured to support the baby's back neck by the structure connected to the support body 110 of the second body B2 instead of simply supporting the back neck while being separated from the support body 110. Accordingly, the back neck support step 220 can stably and firmly support the baby's back neck while the baby is lying on his or her side.

Here, the back neck support step 220 is formed to have a curved edge to correspond to the outer shape of the back neck.

That is, by having a structure in which an edge surface that supports the baby's back neck has a curved shape to correspond to the shape of the baby's back neck, the back neck support step 220 supports the back neck while in contact with the entire neck instead of partially supporting the back neck. Accordingly, the baby's back neck can be stably and firmly supported.

Further, the back neck support step 220 is disposed so that, when the two heads H1 and H2 are stacked while intersecting with each other, a portion of the back neck support step 220 overlaps with a portion of the occipital region support step 210. In this way, the height at which the back neck support step 220 protrudes is increased, and thus the baby's back neck can be more stably and firmly supported.

As described above, by including the occipital region support step 210 and the back neck support step 220, the support portion 200 of the present invention can implement a structure that supports the entire occipital region and back neck of the baby along the contour of the baby's head from the lateral direction and the lower side in the lateral direction when the baby is lying on his or her side. Accordingly, the baby's head can be stably and firmly supported.

Further, the two heads H1 and H2 stacked while intersecting with each other to support the baby's head have a double step area D formed in which a portion of the occipital region support step 210 supports the back neck support step 220 and the occipital region support step 210 and the back neck support step 220 intersect with each other.

That is, the double step area D has a double pad structure in which the occipital region support step 210 and the back neck support step 220, which are two thick pad structures, are sequentially stacked.

The double step area D configured as above serves to allow the occipital region support step 210 to lift the back neck support step 220 to cause the back neck support step 220 to be in close contact with the baby's back neck. That is, the back neck support step 220 which primarily supports the baby's back neck is further lifted by the occipital region support step 210 and pushed toward the baby's back neck, and thus the back neck support step 220 comes into close contact with the baby's back neck and firmly supports the baby's back neck with a certain pressure. Accordingly, the baby's back neck can be more stably supported.

Figure 5A:
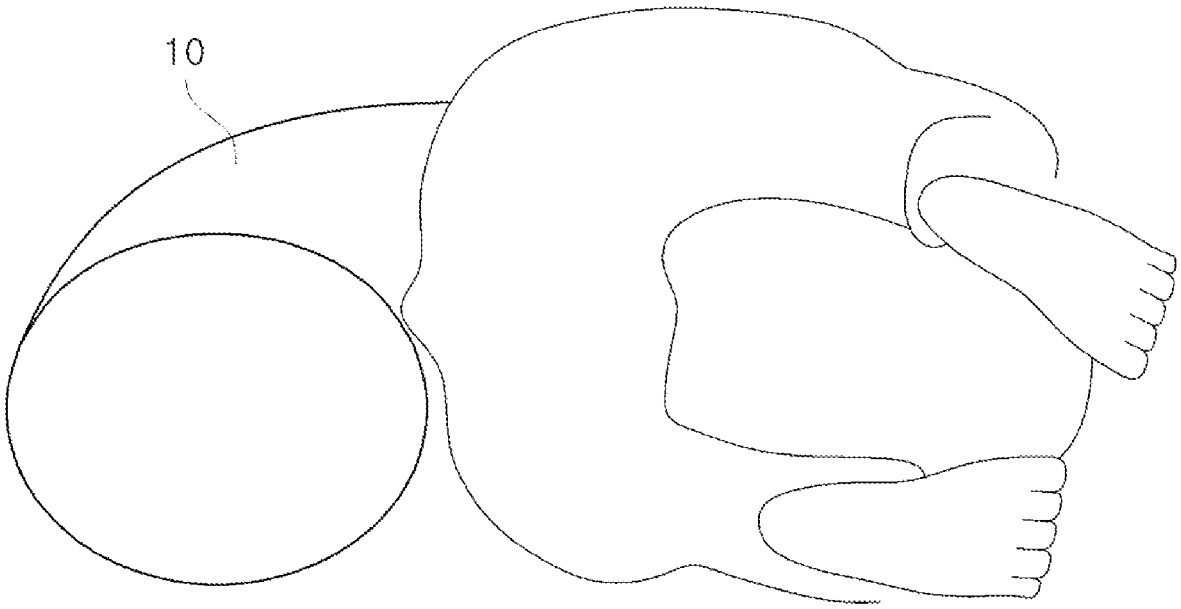
FIG. 5A is a view illustrating a state in which the baby's back is supported by the cushion of FIG. 1.
Figure 5B:
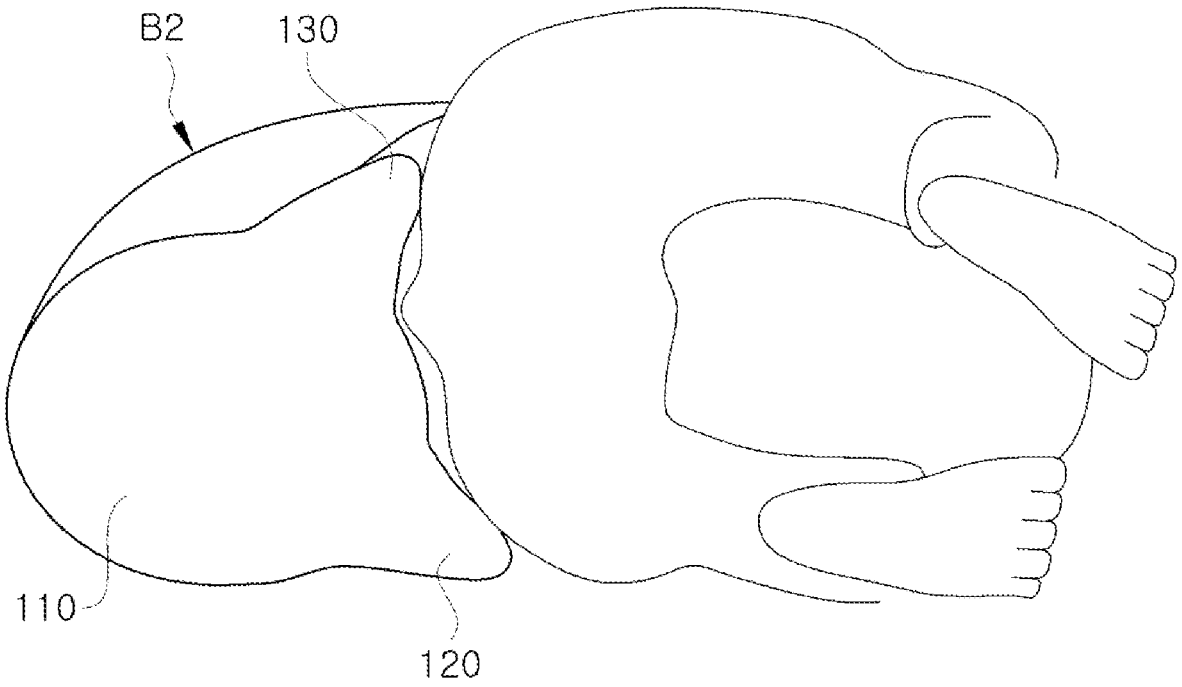
FIG. 5B is a view illustrating a state in which the baby's spine is supported by a first support and a second support of the apparatus for assisting sleep of FIG. 3.

FIG. 5A is a view illustrating a state in which the baby's back is supported by the cushion of FIG. 1, and FIG. 5B is a view illustrating a state in which the baby's spine is supported by a first support and a second support of the apparatus for assisting sleep of FIG. 3.

Referring to FIG. 5A, the conventional cylindrical cushion 10 has a simple cylindrical structure and simply supports the spinal cord from the lateral direction instead of surrounding and supporting the spinal cord. Further, the conventional cylindrical cushion 10 has a structure in which the spinal cord cannot be firmly supported in the lateral direction unless the cushion is in close contact with the baby's body. In particular, when the baby attempts to turn leftward in the drawings, the spine enters a space between the floor and the support body 110, and thus there is a limitation in firmly supporting the baby.

On the other hand, as illustrated in FIGS. 3 and 5B, the present invention may include a first support 120 configured to support the baby's spine from the lower side in the lateral direction.

That is, according to the present invention, one of the two bodies B1 and B2 includes the support body 110 and the first support 120. As an example, as illustrated in the drawings, the first support 120 may be formed on the second body B2.

The support body 110 of the second body B2 supports the back of the baby's body from the lateral direction, and the first support 120 of the second body B2 has a structure that protrudes in a direction inclined downward from a lower portion of a side of the support body 110 that supports the back of the baby's body in order to support the baby's spine from the lower side in the lateral direction.

The first support 120 protrudes from the support body 110 toward a lower side of the spine on the back of the baby lying on his or her side (downward in the drawings) and is disposed to be fitted between the floor and the lower side of the baby's spine. Accordingly, the first support 120 can stably and firmly support the baby's spine from the lower side in the lateral direction. In particular, when the baby attempts to turn leftward in the drawings, as the spine is supported by the first support 120 which is present in a space between the floor and the support body 110, the baby can be firmly supported.

For reference, an anti-slip fabric may be utilized for the first support 120.

Also, as illustrated in FIG. 5B, the present invention may further include a second support 130 configured to support the baby's spine from an upper side in the lateral direction.

That is, according to the present invention, one of the two bodies B1 and B2 includes the second support 130. As an example, as illustrated in the drawings, the second support 130 may be formed on the second body B2.

The second support 130 of the second body B2 has a structure that protrudes in a direction inclined upward from an upper portion of the side of the support body 110 that supports the back of the baby's body in order to support the baby's spine from the upper side in the lateral direction.

The second support 130 may serve to block turning of the back of the baby's body toward an upper portion of the second body B2 with a certain force. That is, when the baby attempts to turn leftward in the drawings, as the spine is supported by the second support 130 from the upper side in the lateral direction, the baby can be stably and firmly supported, and turning of the baby can be prevented.

Further, the roles of the first support 120 and the second support 130 may be switched. Although the baby is lying on the left side in the drawings, the baby may lie on the right side for head shape correction or the like, and in this way, the side on which the baby lies may be switched between the left and right. Here, when the baby is lying on the right side unlike in the drawings, the second body B2 of the present invention is also used after being rotated so that upper and lower surfaces thereof are switched. In this case, the second support 130 supports the baby's spine from the lower side in the lateral direction, and the first support 120 supports the baby's spine from the upper side in the lateral direction.

For reference, an anti-slip fabric may be utilized for the second support 130.

As a result, due to including the support portion 200 configured to support the baby's head and neck from the circumference thereof, the apparatus for assisting sleep according to the present invention can stably and firmly support the baby's head and neck while the baby is lying on his or her side.

Further, due to including the first support 120 configured to support the baby's spine from the lower side in the lateral direction and the second support 130 configured to support the baby's spine from the upper side in the lateral direction, the present invention can stably and firmly support the baby's spine and prevent the baby from turning.

In this way, by accurately and reliably supporting the three parts, the head, neck, and back (spine) of the baby, the present invention can implement a structure which is the most suitable for the baby to continuously maintain lying on his or her side.

Consequently, due to including a support portion configured to support a baby's head and neck from a circumference thereof, an apparatus for assisting sleep according to the present invention has an effect of stably and firmly supporting the head and neck of a baby lying on his or her side.

Further, due to including a first support configured to support the spine of the baby from a lower side in the lateral direction and a second support configured to support the spine of the baby from an upper side in the lateral direction, the present invention has advantages in that it is possible to stably and firmly support the baby's spine and prevent the baby from turning.

In this way, by accurately and reliably supporting the three parts, the head, neck, and back (spine) of the baby, the present invention can implement a structure which is the most suitable for the baby to continuously maintain lying on his or her side, and thus there are advantages in that stable sleep without the Moro reflex is possible and a head deformity such as a flat head can be prevented for the baby.

The present invention has been described above using exemplary embodiments and drawings, but the present invention is not limited thereby, and of course, those of ordinary skill in the art to which the present invention pertains may make various modifications and changes within the scope of the technical spirit of the present invention and the attached claims and their equivalents.

What is claimed is:

1. An apparatus for assisting sleep, the apparatus comprising:

a main body which comprises two bodies configured to support a body of a baby, and a head formed at one end portion of one of the two bodies to support a head of the baby; and a support portion which is formed at the main body and configured to support the head of the baby and a neck of the baby from a circumference thereof, wherein at least one of the two bodies has a cross-section that is circular or oval and perpendicular to a longitudinal direction of the at least one of the two bodies, wherein the support portion comprises a support step which extends from at least one of the two bodies to an inside of the head and is formed thicker than other parts of the head.

2. The apparatus of claim 1, wherein the main body comprises two heads respectively formed, and wherein the support step comprises an occipital region support step which is formed thicker than other parts of one of the two heads to protrude upward from one side portion of the one of the two heads to support the occipital region of the baby from a lateral direction and a lower side in the lateral direction in a state in which the two heads are stacked while intersecting with each other to support a temporal region of the baby.

3. The apparatus of claim 2, wherein an insertion groove is formed in a central portion of one of the two heads so that a portion of the temporal region is configured to be inserted therein.

4. The apparatus of claim 2, wherein at least one of the two bodies comprises:

a support body configured to support a back of the body of the baby from the lateral direction; and a first support formed to protrude in a direction inclined downward from a lower portion of a side of the support body that is configured to support the back of the body of the baby in order to support the spine of the baby from the lower side in the lateral direction.

5. The apparatus of claim 4, wherein the one of the two bodies further comprises a second support formed to protrude in a direction inclined upward from an upper portion of the side of the support body that is configured to support the back of the baby's body of the baby in order to support the spine of the baby from an upper side in the lateral direction.

6. The apparatus of claim 2, wherein at least one of the two bodies includes comprises a support body configured to support a back of the body of the baby from the lateral direction, and the support step further comprises a back neck support step which is formed to extend from the support body to an inner side of one of the two heads and formed thicker than the one of the two heads to protrude upward therefrom in order to support a back neck of the baby from the lateral direction and the lower side in the lateral direction.

7. The apparatus of claim 6, wherein the back neck support step is formed in a shape that is configured to match the outer shape of the back neck of the baby and has an edge formed to be curved.

8. The apparatus of claim 6, wherein the two heads stacked while intersecting with each other to support the head of the baby have a double step area formed in which a portion of the occipital region support step supports the back neck support step and the occipital region support step and the back neck support step intersect with each other, and in the double step area, the occipital region support step lifts the back neck support step and is configured to cause the back neck support step to be in close contact with the back neck of the baby.

9. The apparatus of claim 1, wherein the two bodies are configured so that the other end portion of one body and the other end portion of the other body are connected to each other, and wherein the two bodies are formed to have a structure in which connecting portions are attached to and detached from each other.

10. The apparatus of claim 2, wherein each of the bodies and the heads is filled with a filler, and a zipper opening/closing portion is formed to allow entry and exit of the filler into and from each of the bodies and the heads.

* * * * *